US009141085B2

(12) United States Patent
Wachi et al.

(10) Patent No.: US 9,141,085 B2
(45) Date of Patent: Sep. 22, 2015

(54) IMAGE FORMING APPARATUS

(71) Applicant: PANASONIC CORPORATION, Osaka (JP)

(72) Inventors: Hayato Wachi, Fukuoka (JP); Youichi Idera, Fukuoka (JP); Masaya Shitami, Fukuoka (JP); Takanori Kitagawa, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/339,216

(22) Filed: Jul. 23, 2014

(65) Prior Publication Data

US 2015/0030348 A1 Jan. 29, 2015

(30) Foreign Application Priority Data

Jul. 23, 2013 (JP) ..... 2013-152769

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC ..... G03G 15/2017; G03G 21/206
USPC ..... 399/91, 92, 93
See application file for complete search history.

(56) References Cited

U.S. PATENT DOCUMENTS

| | | | | |
|---|---|---|---|---|
| 2001/0026703 | A1* | 10/2001 | Kushida | 399/93 |
| 2006/0269314 | A1* | 11/2006 | Lee et al. | 399/92 |
| 2007/0059020 | A1 | 3/2007 | Yoshikawa | |
| 2008/0145092 | A1 | 6/2008 | Tomatsu et al. | |
| 2009/0290209 | A1 | 11/2009 | Kubo | |
| 2009/0290897 | A1 | 11/2009 | Doshoda et al. | |
| 2011/0211859 | A1 | 9/2011 | Shimoyama et al. | |
| 2013/0016992 | A1* | 1/2013 | Watanabe | 399/92 |

FOREIGN PATENT DOCUMENTS

| | | | | |
|---|---|---|---|---|
| JP | 11231760 | A * | 8/1999 | G03G 21/20 |
| JP | 2002-318514 | A | 10/2002 | |
| JP | 2009-192679 | A | 8/2009 | |
| JP | 2009-258537 | A | 11/2009 | |
| JP | 2009-282455 | A | 12/2009 | |
| JP | 2009-282456 | A | 12/2009 | |

(Continued)

OTHER PUBLICATIONS

International Search Report dated Nov. 5, 2014, for corresponding International Application No. PCT/JP2014/069987, 12 pages.

*Primary Examiner* — David Gray
*Assistant Examiner* — Thomas Giampaolo, II
(74) *Attorney, Agent, or Firm* — Seed IP Law Group PLLC

(57) ABSTRACT

An image-forming apparatus comprising a fuser assembly including a heating roller and a pressure roller for fixing a non-fixed image on paper, a duct located in the vicinity of the fuser assembly in parallel to an axis line of the heating roller, an exhaust outlet located on a first side wall of the duct at the fuser assembly side, wherein the exhaust outlet is provided to connect the fuser assembly and the duct, and a plane filter detachably attached to an inside wall of the duct in parallel to the inside wall.

12 Claims, 7 Drawing Sheets

(56) References Cited

FOREIGN PATENT DOCUMENTS

| | | | |
|---|---|---|---|
| JP | 2010-107895 | A | 5/2010 |
| JP | 2011-107500 | A | 6/2011 |
| JP | 2011-180235 | A | 9/2011 |
| JP | 2011-180283 | A | 9/2011 |

* cited by examiner

IMAGE FORMING APPARATUS

BACKGROUND

The present invention relates to an image forming apparatus based on an electrographic process.

Regarding image forming apparatuses based on the electrographic process, it is known that several types of chemical substances are released from the image forming apparatus when images are formed. Examples among the released chemical substances are such as ozone which is generated when the photoreceptor drum is charged and toner dusts which are generated when images are developed or fixed. In the past, for example, filters are installed to prevent such generated chemical substances from being released outside the image forming apparatus.

For example, in JP-A-2009-282455, an electric field generating and collecting component generates an electric field in the air of the exhaust air duct, which is located over the fuser assembly in the volatile chemical substance collecting apparatus of an electronic device. VOC (Volatile Organic Compounds) in the air is drawn to the surface of the electric field generating and collecting component and is collected by effect of the electric field.

In JP-A-2011-180235, an image forming apparatus includes a duct which is located near the fuser apparatus, and the duct has a collecting hole for collecting particulates generated by the heating roller in fuser apparatus. An exhaust fan, which causes an air current from the collecting hole to an outlet, is provided in an expanded portion of the duct, and a first filter is provided in the upstream of the exhaust fan. The first filter collects ultrafine particles (e.g. siloxane) generated by a rubber layer, which constitutes the fuser apparatus. A shutter is provided to fill a gap between the first filter and the expanded portion, and a control part of the image forming apparatus switches between a state that the shutter covers the first filter and another state that the shutter does not cover the first filter according to a predetermined initial burst conditions.

Furthermore, in JP-A-2011-180283, a deodorization apparatus of a complex image forming apparatus includes plural gas passages, located at a bottom of housing, through which the gas flows into the housing. Each gas passage is tubular-shaped and an inside diameter of the upper part of housing is smaller than an inside diameter of the bottom of housing, and an ozone decomposing filter, which includes catalytic decomposing of ozone, is provided at a surface of the inside diameter of the tubular shape. A waste liquid absorber is provided at the inside bottom of the housing, a deodorizing absorber is provided at the upper lid in the housing, and an exhaust outlet for the gas which passes between the waste liquid absorber and the deodorizing absorber is provided on a side surface of the housing.

A recently growing concern is that the image forming apparatus based on the electrographic process generates particles (e.g. UFP (Ultrafine Particle) each having a diameter of less than 100 nm, which are different from ozone and the like, as the worldwide environmental conservation awareness grows.

However, for example, if the volatile chemical substance collecting apparatus of an electronic device, which draws VOC to the surface of the electric field generating and collecting component and collects it as shown in JP-A-2009-282456, is added as a structure for collecting UFP, it becomes a complex structure.

And if the first filter which is capable of collecting particles is provided in the upstream of the exhaust fan in the image forming apparatus and exhaust air passes through the first filter as shown in JP-A-2009-282456, it decreases the exhaust efficiency and increase the temperature in the housing because the first filter increases resistance when the air flows. Therefore, an output of the exhaust fan has to be increased, which leads to a concern that it generates noise and increases its running cost.

Furthermore, if a plurality of dedicated deodorization apparatuses are provided like the complex image forming apparatus shown in JP-A-2011-180283 (e.g. two deodorization apparatuses are described in JP-A-2011-180283), the structure becomes complex and the cost of the apparatus increases.

SUMMARY

According to one aspect of the present invention, an image forming apparatus is provided, which is simple in structure, reduces an emission of UFP, and curbs an output increase in the exhaust fan.

According to one embodiment, an image-forming apparatus is provided, comprising a fuser assembly including a heating roller and a pressure roller. The fuser assembly is for heating and pressurizing paper, on which a non-fixed image is applied and fixed. The image-forming apparatus also comprises a duct, which is located in the vicinity of the fuser assembly and which is parallel to an axis line of the heating roller. That is, a longitudinal direction of the duct is parallel to an axis line of the heating roller. An exhaust fan is located at an end of the duct in the longitudinal direction, and exhausts air from the duct. An exhaust outlet is located on a first side wall of the duct at the fuser assembly side. The exhaust outlet connects between the fuser assembly and the duct. A plane filter is attached to an inside wall of the duct so as to be parallel to the inside wall.

In the image-forming apparatus described above, there is no waste of space in the multifunction printer because the duct is located parallel to the axis line of the heating roller and adjacent to the fuser assembly. As a result, the configuration of the multifunction printer is simple and compact. Also, maintenance is easy because it is easy to replace the filter.

Furthermore, the filter contacts the exhaust air for a long time because the longitudinal direction of the filter is parallel to the longitudinal direction of the duct. The filter has increased efficiency in catching UFP and is able to reduce the emission of UFP to outside of the multifunction printer. Furthermore, the filter does not cross over into the air-conveying space of the duct. Therefore, the filter can curb increase in resistance of air when the exhaust air in the enclosure flows, and can curb increase in the output of the exhaust fan, which is different from the conventional transmission filter.

According to another aspect of the present invention, an image-forming apparatus is provided, comprising a fuser assembly including a heating roller and a pressure roller. The fuser assembly is for heating and pressurizing paper, on which a non-fixed image is applied and fixed. The image-forming apparatus also comprises a fuser assembly enclosure configured to enclose the fuser assembly. The image-forming apparatus further includes a duct including a first side wall, which is a part of a wall section of the fuser assembly enclosure. A longitudinal direction of the duct is parallel to an axis line of the heating roller. An exhaust fan is located at an end of the duct in the longitudinal direction. An exhaust outlet is located on the first side wall. The exhaust outlet connects between the fuser assembly and the duct. A plane filter is attached to an inside wall of the duct so as to be parallel to the inside wall.

In the image-forming apparatus described above, it is possible to produce a multifunction printer easily because the duct is also a part of the wall section of the fuser assembly enclosure. Also, there is no waste of space in the multifunction printer because the duct is located parallel to the axis line of the pressure roller and adjacent to the fuser assembly enclosure. As a result, the configuration of the multifunction printer is simple and compact. Also, maintenance is easy because it is easy to replace the filter.

Furthermore, the filter contacts the exhaust air in the enclosure for a long time because the longitudinal direction of the filter is parallel to the longitudinal direction of the duct. The filter has increased efficiency in catching UFP and is able to reduce the emission of UFP to outside of the multifunction printer. Furthermore, the filter does not cross over into the air-conveying space of the duct. Therefore, the filter can curb increase in resistance of air when the exhaust air in the enclosure flows, and can curb increase in the output of the exhaust fan, which is different from the conventional transmission filter.

DETAILED DESCRIPTION OF EXEMPLARY EMBODIMENTS

An embodiment of an image forming apparatus of the present invention (hereafter referred to as the "present embodiment") will be described with reference to the accompanying drawings. In the present embodiment as described below, an electrographic multifunction printer is described as one example of the image forming apparatus according to the present invention. However, the image forming apparatus according to the present invention is not limited to the multifunction printer, and is also applicable to a copier, a printer, or the like.

Figure 1:
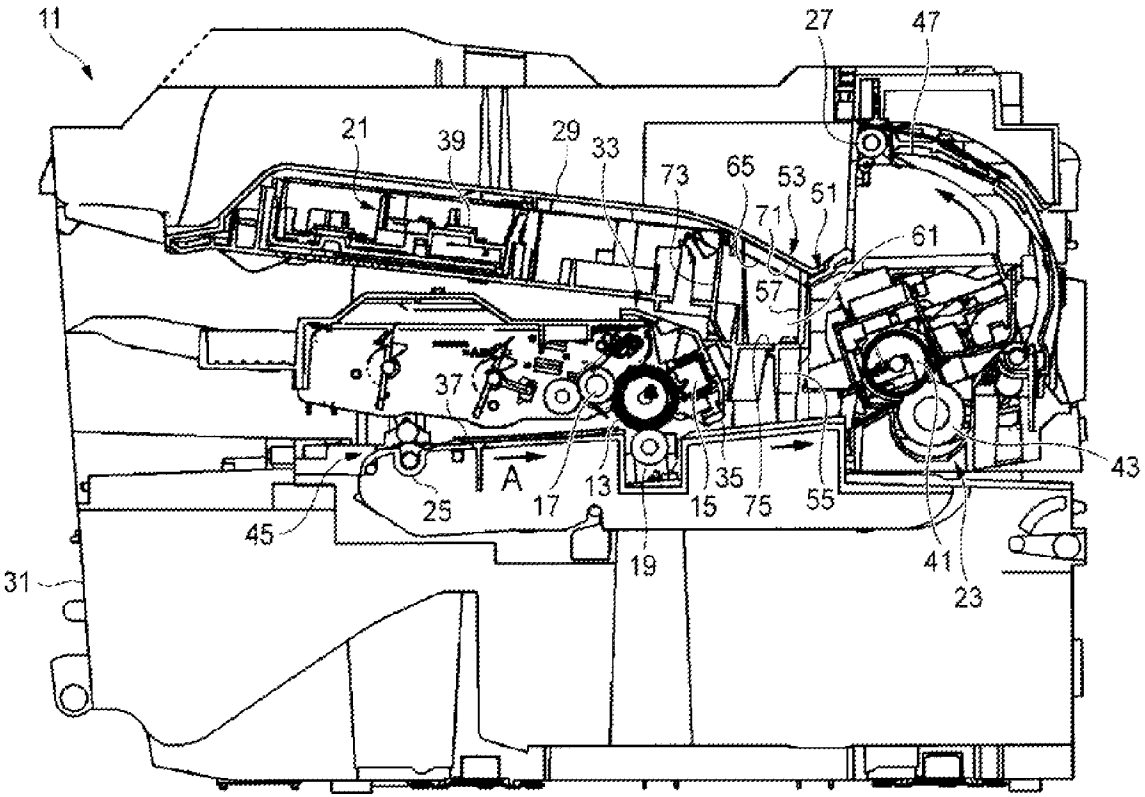
FIG. 1 is a vertical cross-sectional view of a multifunction printer according to an embodiment of the present disclosure.
Figure 2:
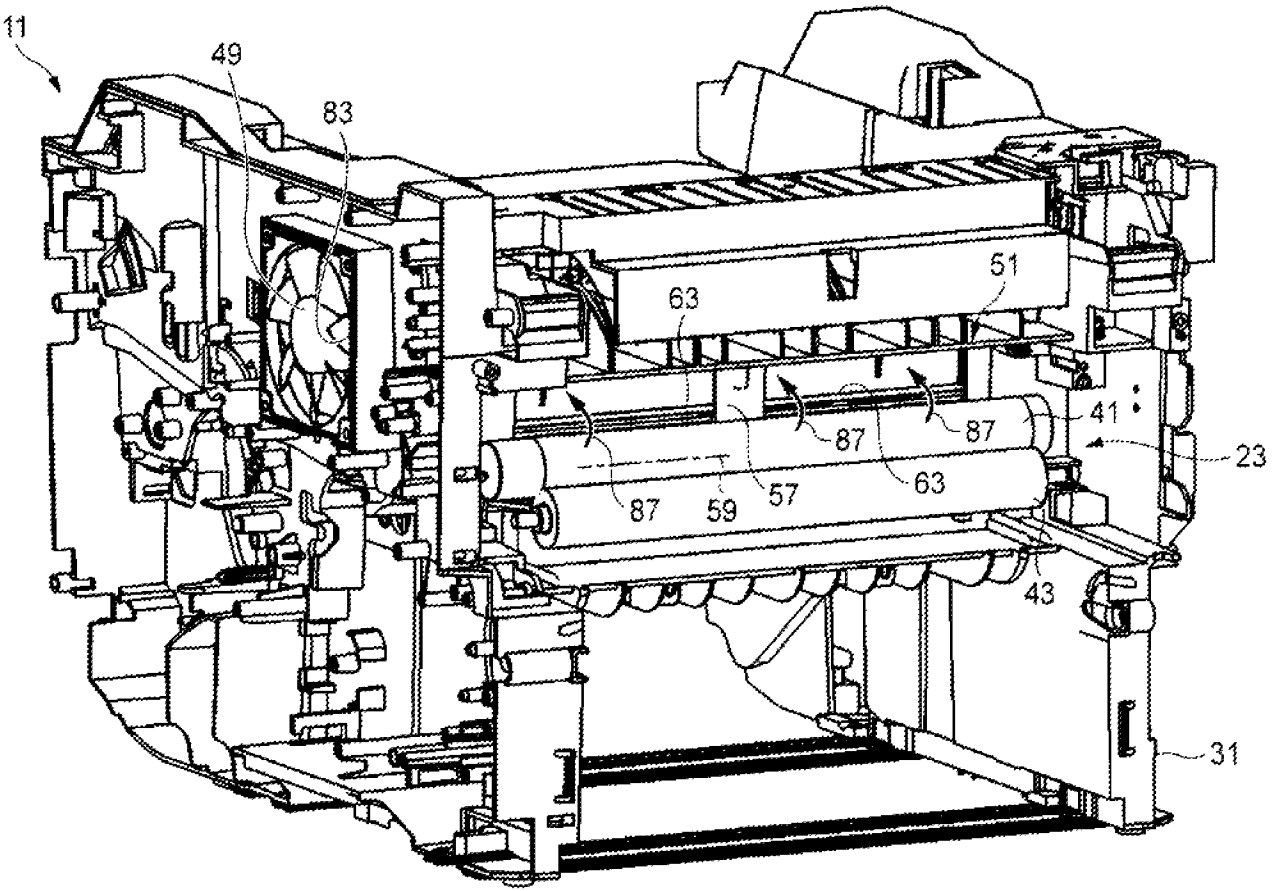
FIG. 2 is a perspective view of a first side wall, viewed from the fuser assembly enclosure side of the multifunction printer shown in FIG. 1.
Figure 3:
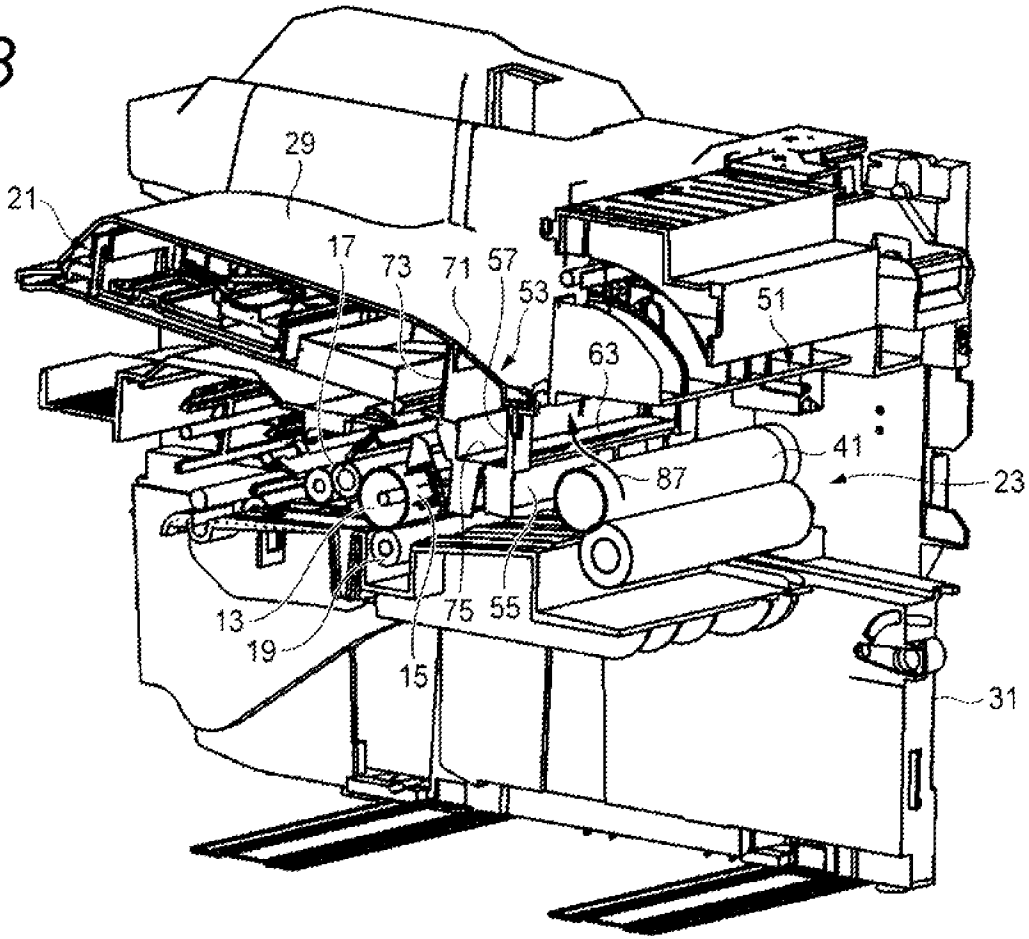
FIG. 3 is a perspective cross-sectional view of FIG. 2, taken from a middle position of a heating roller in a longitudinal direction.
Figure 4:
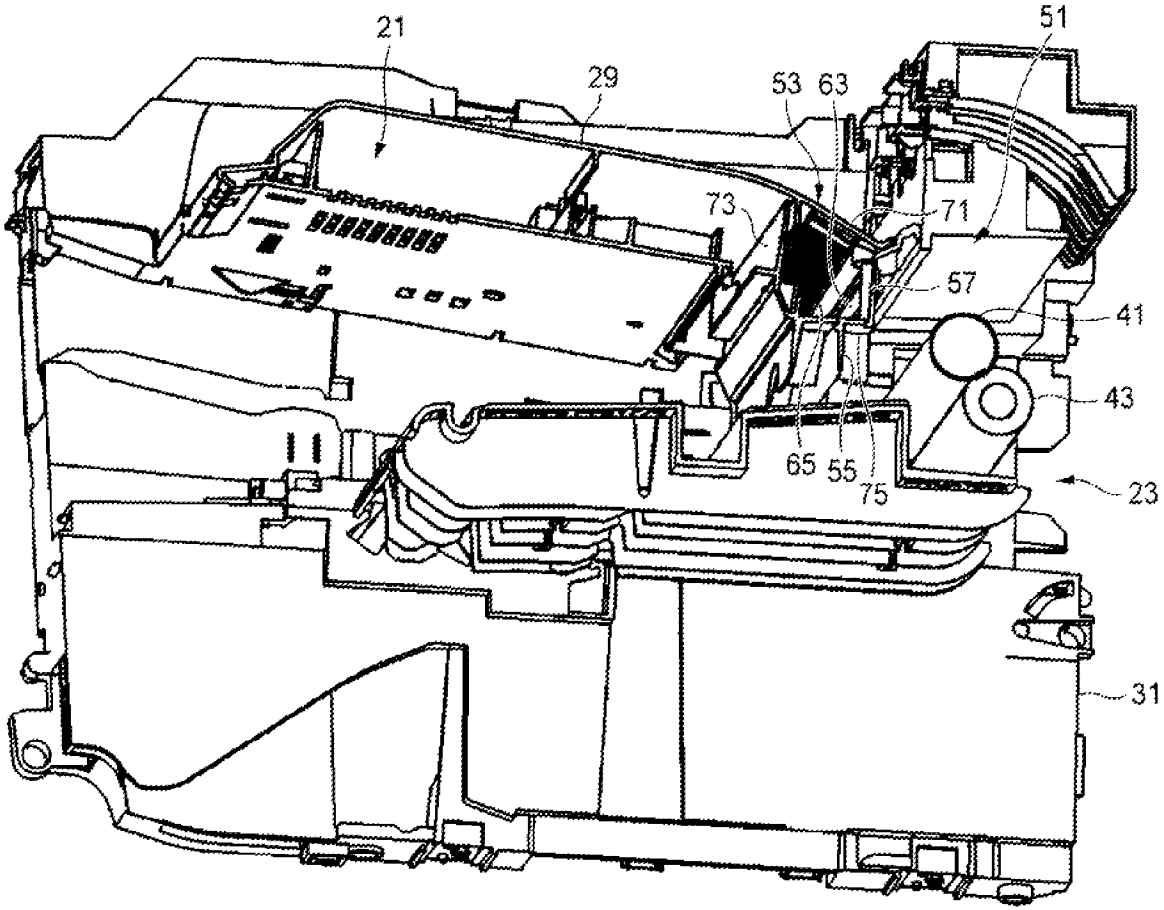
FIG. 4 is a perspective view of FIG. 3, viewed from the lower side of the duct side.
Figure 5:
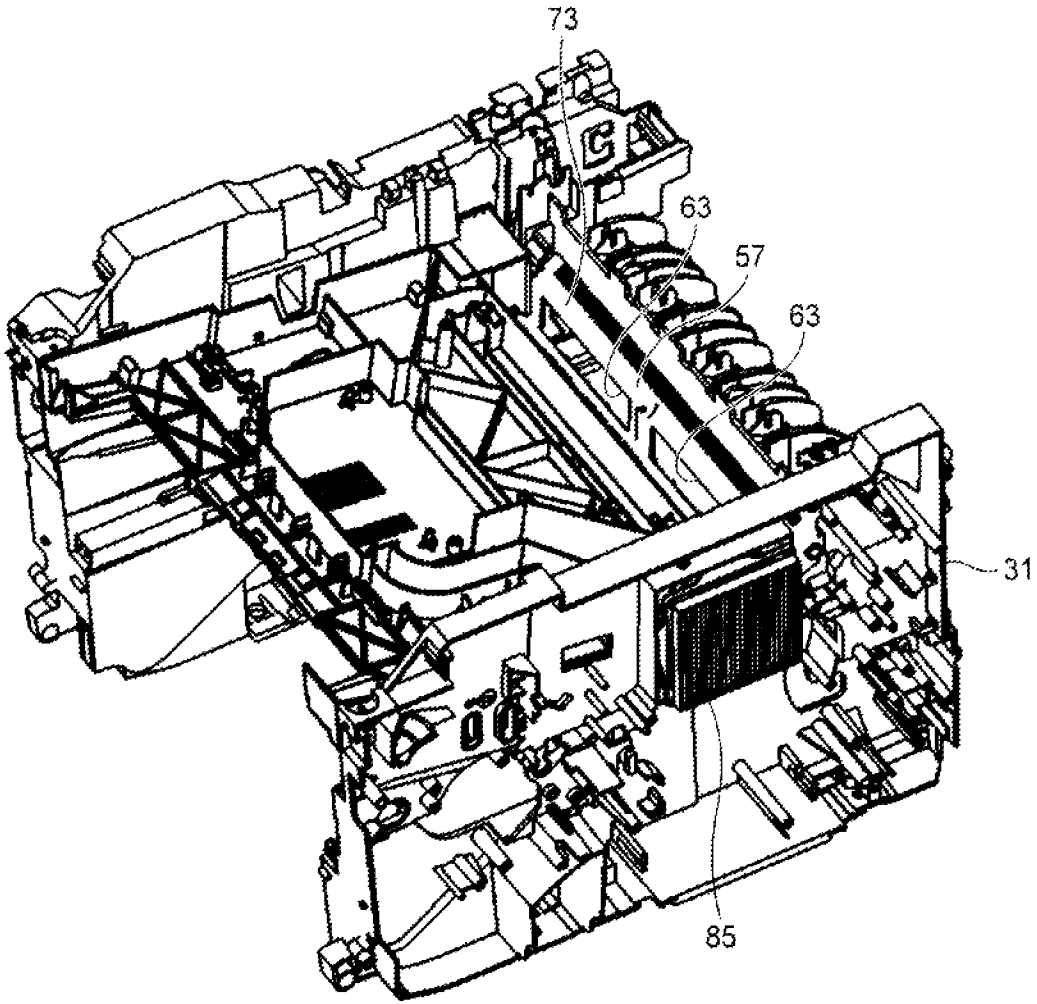
FIG. 5 is a perspective view of an exhaust outlet on the first side wall, viewed from the upper side, with illustration of a duct ceiling surface removed.
Figure 6:
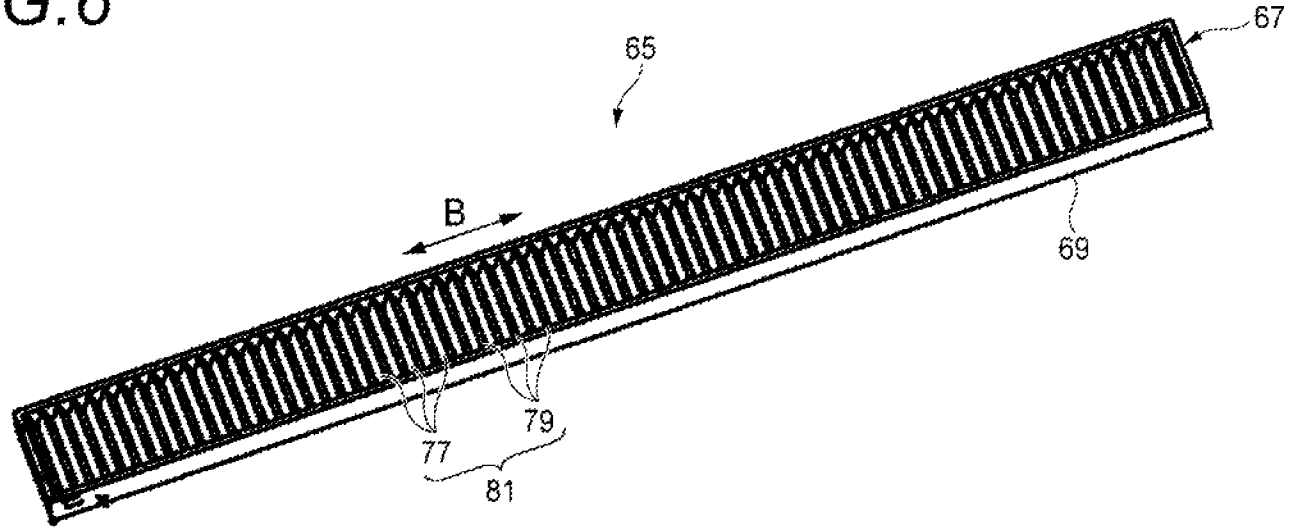
FIG. 6 is a perspective view of a filter.
Figure 7:
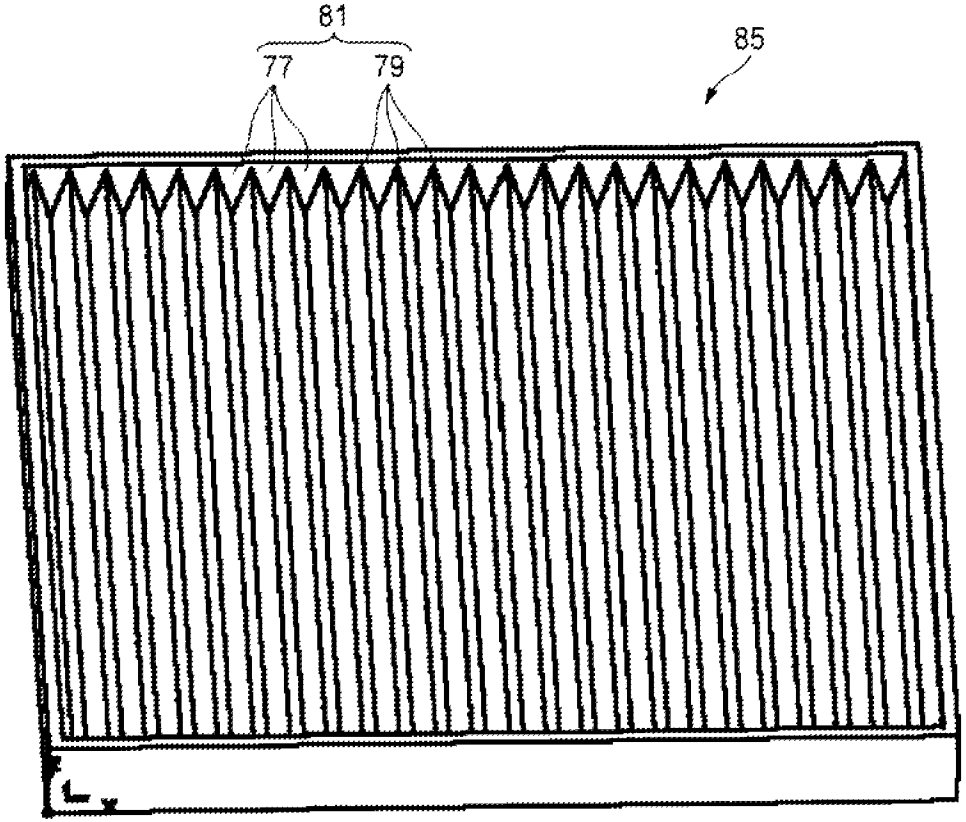
FIG. 7 is a perspective view of a transmission filter.

FIG. 1 is a vertical cross-sectional view of a multifunction printer according to an embodiment of the present disclosure. FIG. 2 is a perspective view of a first side wall, viewed from the fuser assembly enclosure side of the multifunction printer shown in FIG. 1. FIG. 3 is a perspective cross-sectional view of FIG. 2, taken from a middle position of a heating roller in a longitudinal direction. FIG. 4 is a perspective view of FIG. 3, viewed from lower side of the duct side. FIG. 5 is a perspective view of an exhaust outlet on the first side wall from the upper side, with illustration of a duct ceiling surface removed. FIG. 6 is a perspective view of a filter. FIG. 7 is a perspective view of a transmission filter.

A multifunction printer 11 of the present embodiment has functions as, for example, a scanner, copier, and printer, and forms (fixes) mono-color or multicolor images on paper (e.g. recording materials or record paper) and eject it according to print job data, which is inputted from an external device such as a PC (Personal Computer).

The multifunction printer, shown in FIG. 1, comprises at least a photoreceptor drum 13, a charging unit 15, a development roller 17, a transfer roller 19, an exposure device 21, a fuser assembly 23, a paper cassette (not shown in figures), a paper transfer roller 25, a paper eject roller 27, and a paper catch tray 29 in a main body casing 31.

For example, a pair of visible image forming units (process unit) 33 is provided almost in the center of the main body casing 31 of the multifunction printer 11 shown in FIG. 1. For ease of explanation, the pair of visible image forming units 33 for forming black images is provided in the multifunction printer 11 shown in FIG. 1 as an example. However, other visible image forming units may also be provided, which have similar structure to the visible image forming unit 33 for other colors such as yellow, magenta, and cyan respectively.

The visible image forming unit 33 includes the photoreceptor drum 13, which carries electrostatic latent images according to the print job data inputted to the multifunction printer 11. The charging unit 15, the development roller 17, the transfer roller 19 and a cleaning unit 35 are located around the photoreceptor drum 13.

The charging unit 15 uniformly charges a surface of the photoreceptor drum 13 to a predetermined potential (e.g. negative potential). It is preferable that the charging unit 15 is, for example, a charging roller type, which can uniformly charge the surface of the photoreceptor drum 13 with a minimum amount of ozone which is generated when the photoreceptor drum 13 is charged. However, the charging unit 15 is not limited to the charging roller type and, for example, may be a contact type brush and a non-contact charger type.

The development roller 17 visualizes the electrostatic latent image, which the exposure device 21 (described below) forms on the photoreceptor drum 13, by use of the toner which is provided to the development roller 17. As a result, a toner image is provided according to the print job data. In the present embodiment, for example, a black toner is provided to the development roller 17. The multifunction printer 11 may include other visible image forming units, which have similar structure to visible image forming unit 33 for other colors such a yellow, magenta, and cyan respectively, and the toner of each color may be also provided to each development roller of visible image forming units.

The transfer roller 19 faces the photoreceptor drum 13 and transfers the toner image, which is formed on the surface of the photoreceptor drum 13, on paper 37 which is transferred along a paper transfer path 45. Hereafter, the toner image which the transfer roller 19 transfers on the paper 37 is referred to as a "non-fixed image".

The cleaning unit 35 removes and collects the toner, which is left on the surface of the photoreceptor drum 13, after the transfer process of the transfer roll 19.

The exposure device 21 includes LSU (Laser Scanning Unit) 39. The LSU 39 includes a laser light source, a polygon mirror which scans a laser light which is emitted by the laser light source 21, and a lens and a reflective mirror which brings the laser light, which is scanned by the polygon mirror, to the photoreceptor drum 13. The LSU 39 exposes the surface of the photoreceptor drum 13 to the laser light from the polygon mirror and forms the electrostatic latent image on the photoreceptor drum 13 according to the print job data.

The fuser assembly 23 includes the heating roller 41 and the pressure roller 43, and the long direction of them is vertical to the paper 37. The heating roller 41 is heated to a predetermined temperature (e.g. fixing temperature, 180-200 degrees C.) by a heater as a source of heat. The pressure roller 43 is biased against the heating roller 41 by a spring (not shown in figures). The fuser assembly 23 heats and pressurizes the paper 37. to which the toner image is transferred by the heating roller 41 and the pressure roller 43. The fuser assembly 23 fixes the non-fixed image to the paper 37.

The paper transfer path 45 between the paper cassette (not shown in figures) and the paper catch tray 29 is provided in the main body casing 31. In the paper transfer path 45, the paper 37 is transferred from the paper transfer roller 25, passes between the photoreceptor drum 13 and the transfer roller 19, and then passes through the fuser assembly 23, and reaches the paper eject roller 27. In FIG. 1, the paper transfer path 45 is an arrowed line A. The paper transfer path 45 changes to the paper eject path 47 just before the paper eject roller 27. Also, the paper eject path 47 includes a switchback transfer path (not shown in figures), which transfers the paper 37 to the transfer roller 19 again in the case of doubleside printing.

Furthermore, a control part (not shown in figures) is provided, which controls the entire operation of the multifunction printer 11. The control part includes a processor (e.g. CPU (Central Processing Unit), MPU (Micro Processing Unit), or DPU (Digital Signal Processor)). The control part controls operation of each parts of the multifunction printer 11, which are the photoreceptor drum 13, the charging unit 15, the development roller 17, the transfer roller 19, the exposure device 21, the fuser assembly 23, the paper transfer roller 25, and the paper eject roller 27. Also, the controller controls the exhaust fan 49 (described below) shown in FIG. 2.

The control part of the multifunction printer 11, which includes compositions described above, operates image forming process as described below.

Firstly, the paper transfer roller 25 transfers the paper 37 one by one from the paper cassette (not shown in figures) to the paper transfer path 45 when images are formed.

After the charging unit 15 uniformly charges the surface of the photoreceptor drum 13, the exposure device 21 exposes the surface of a charged area of the photoreceptor drum 13 to the laser light according to the print job data inputted by the external device. Therefore, an electrostatic latent image is formed on the surface of the photoreceptor drum 13 according to the print job data. Then, the development roller 17 visualizes the electrostatic latent image, which is formed on the surface of the photoreceptor drum 13, by use of the toner which is provided by the development roller 17. As a result, a toner image is provided according to the print job data.

Furthermore, the transfer roller 19 transfers the toner image, which is formed on the surface of the photoreceptor drum 13, on paper 37 which is fed and transferred from the paper cassette (not shown in figures) by the paper transfer roller 25. Therefore, the non-fixed toner image is transferred on the paper 37 according to the print job data. The paper 37 with the non-fixed toner image is transferred to the fuser assembly 23. The heating roller 41 and the pressure roller 43 of the fuser assembly 23 sufficiently heats and pressurizes, respectively, the non-fixed toner image to fix it on the paper 37. Therefore, an image is formed on the paper 37 according the print job data, and the paper 37 is ejected to the paper catch tray 29 by the paper eject roller 27.

The multifunction printer 11 of the present embodiment includes the fuser assembly enclosure 51, which encloses the fuser assembly 23. Regarding the fuser assembly enclosure 51, the inside of the fuser assembly enclosure 51 is a cavity, which is airtight enough to prevent UFP, which is generated at the fuser assembly 23, from leaking to the outside of the fuser assembly enclosure 51. More specifically, the fuser assembly enclosure 51 is formed by connecting plural plate materials fixed to the main body casing 31 and a resin mold material. Small openings, which reach outside of the cavity, such as the paper transfer path 45, may be provided because the suction of the exhaust fan 49 (described below) creates negative pressure inside of the fuser assembly enclosure 5. Also, the fuser assembly enclosure 51 is not in vacuum because an outside air comes in through the opening. The fuser assembly enclosure 51 may include a dedicated inlet.

A duct 53 is provided adjacent to the fuser assembly enclosure 51. The longitudinal direction of the duct 53 is parallel to the axis 59 of the heating roller 49 (shown in FIG. 2). An axis of the duct 53 is parallel to the axis 59 of the heating roller 49, and the duct 53 is arranged close to the fuser assembly 23. More specifically, a part of a wall section 55 of the fuser assembly enclosure 51 is a first side wall 57 of the duct 53 and the longitudinal direction of the duct 53 is parallel to the axis 59 of the heating roller 49. The exhaust fan 49 (shown in FIG. 2) is provided at an end of the duct 53 in the longitudinal direction, and the exhaust fan 49 exhausts emissions including air, which existed in an air-conveying space 61 (shown in FIG. 1) of the duct 53, to outside of the main body casing 31.

An exhaust outlet 63 (shown in FIG. 2) is provided on the first side wall 57 of the duct 53 at the fuser assembly 23 side, which means the exhaust outlet 63 is provided on the wall section 55 of the fuser assembly enclosure 51 at the first side wall 57 side. The exhaust outlet 63 links between the fuser assembly 23 and the duct 53. More specifically, the exhaust outlet 63 links between the fuser assembly enclosure 51, which surrounds the fuser assembly 23, and the duct 53. In the present embodiment, plural exhaust outlets 63 (two exhaust outlets 53 are described in FIG. 2) are provided along the longitudinal direction of the first side wall 57 as shown in FIG. 2. The distances between the exhaust outlets 63 and the area of the opening space of each of the exhaust outlets 63 are determined in order that an exhaust air in the enclosure 87 (described below) can be exhausted evenly in the longitudinal direction of the fuser assembly enclosure 51.

A planar filter 65 is detachably attached to an inside wall of the duct 65 so as to be parallel to the inside wall. Regarding the filter 65, a filter main body 67 is held inside a frame body 69 as shown in FIG. 6. The filter 65 is detachable from the duct 53, by way of holding the frame body 69 and releasing the frame body 69 by a locking structure and a holding structure such as a track, which are provided inside the duct 53.

The duct 53 includes a rectangular duct ceiling surface 71, which has an inside wall extending along the longitudinal direction of the duct 53. The filter 65 is installed at the duct ceiling surface 71, and more specifically, it is preferable that the shape of the filter 65 is rectangular in order that the filter 65 covers the rectangular duct ceiling surface 71. The filter 65 does not need to be a single unit and may be separated into more than one unit as long as the filter 65 has adequate area to cover most of the duct ceiling surface 71.

The filter 65 may be provided to cover not only the duct ceiling surface 71 but also the entire area or a partial area of the first side wall 57, a second side wall 73, and bottom wall 75. However, if the filter 65 is provided at the first side wall 57, the filter 65 is provided at an area other than the exhaust outlet 63 to avoid covering the exhaust outlet 63.

The duct ceiling surface 71 slants upward as it extends away from the exhaust outlet 63. The second side wall 73, which is on the opposite side of the duct ceiling surface 71 from the first side wall 57, is at an acute angle relative to the duct ceiling surface 71.

The surface of the filter 65 has a concave-convex surface 81, which includes a groove portion 77 and a projecting portion 79, and groove portions 77 and projecting portions 79 are located respectively along longitudinal direction of the duct ceiling surface 71. The groove portion 77 and the projecting portion 79 extend in parallel to each other, orthogonal to the longitudinal direction of the duct ceiling surface 71 (a direction of arrowed line B in FIG. 6). A surface area of the filter 65 is increased because the filter 65 includes the concave-convex surface 81.

The groove portion 77 and the projecting portion 79, which form the concave-convex surface 81, may be in various shapes. For example, the groove portion may be in a V shape and the projecting portion 79 may be in an inverted V shape (not shown in figures). The groove portion 77 and the projecting portion 79 may be in a sine-wave shape, which includes a shape that a bottom of the V shape is curved and a shape that a tip of the inverted V shape is also curved (not shown in figures). Furthermore, the groove portion 77 may be a concave portion, which includes a bottom plane, and the projecting portion 79 may be a convex portion, which includes a plane top surface (not shown in figures).

Also, in the present embodiment, a transmission filter 85 (shown in FIG. 5 and FIG. 7) is provided to cover an exhaust aperture plane 83 (shown in FIG. 2) of the exhaust fan 49. As shown in FIG. 7, the concave-convex surface 81 where the groove portion 77 and the projecting portion 79 are respectively arranged parallel to one another is formed at the surface of the transmission filter 85. A surface area of the transmission filter 85 is increased because the transmission filter 85 includes the concave-convex surface 81. The exhaust air in the enclosure 87 (described below), which flows into the duct 53 through the exhaust outlet 63, passes through the transmission filter 85. The transmission filter 85 is detachably attached to the exhaust aperture plane 83 like the filter 65.

Next is an explanation of the functions of the multifunction printer 11, which includes configurations described above.

In the multifunction printer 11, the non-fixed image is transferred on the paper 37 according to the print job data inputted from an external device, and the paper 37 is transferred to the fuser assembly 23. The paper 37 is caught between the heating roller 41 and the pressure roller 43 in the fuser assembly 23. The non-fixed image on the paper 37 is fixed to the paper 37 as a fixed image because the heating roller 41 heats the paper 37 and the pressure roller 43 pressurizes the paper 37.

It is known that a small amount of the toner, which forms the non-fixed image, is combined with water vapor and is separated from the non-fixed image when the water included in the paper 37 vaporizes in the fuser assembly 23. Usually, the toner includes pigments, waxes, and external additives. The main effect of the external additives is to improve the reaction efficiency with static electricity, and to attach particles such as silica to the surface of the toner. Recently, it is reported that the external additives, which are combined with water vapor and separated from the non-fixed image, are one of the factors that increase the amount of UFP in the multifunction printer 11.

In the present embodiment, the external additives, which are separated from the surface of toner, are transferred to the upper area of the fuser assembly enclosure 51 with water vapor, which is generated when the non-fixed image is fixed on the paper 37, by natural convection and suction from the exhaust fan 49. The first side wall 57, which is a part of the wall section 55, is provided at the upper area of the fuser assembly enclosure 51. The first side wall 57 is a partition wall between the fuser assembly enclosure 51 and the duct 53, which is provided adjacent to the fuser assembly enclosure 51. The longitudinal direction of the duct 53 is parallel to the axis line of the heating roller 41. The multifunction printer is downsized because the duct 53 is separated from the fuser assembly 23 by the partition wall and is located parallel to and adjacent to the fuser assembly 23. The exhaust outlet 63 is provided at the first side wall 57, which is the partition wall, and the exhaustion outlet 63 connects between the inside of the fuser assembly enclosure 51, which is an exposure space of the fuser assembly 23, and the inside of the duct 53 (air-conveying space 61).

In the duct 53, air in the air-conveying space 61 flows toward an end of the duct 53 in the longitudinal direction of the duct 53 by the exhaust fan 49 provided at the end of the duct 53 in the longitudinal direction of the duct 53. Therefore, air in the fuser assembly enclosure 51 is aspirated and flows into the air-conveying space 61, which has negative pressure, of the duct 53 through the exhaust outlet 63. The external additives (UFP), which are combined with water vapor generated when the non-fixed image is fixed on the paper 37, are separated from the surface of the toner. The external additives, most of which are included in the aspirated air (hereinafter referred to as "exhaust air in the enclosure"), flows into the air-conveying space 61 of the duct 53 with other VOC (Volatile Organic Compounds) and dusts.

The surface of the plane filter 65, which is installed to be parallel to the inside wall of the duct 53, is exposed to the exhaust air in the enclosure 87 shown in FIGS. 2 and 3 when the exhaust air in the enclosure 87 flows toward the end of the duct 53 in the longitudinal direction. It is confirmed that UFP (Ultrafine Particle) included in the exhaust air in the enclosure 87 is caught by the filter 65 because the exhaust air in the enclosure 87 touches the filter 65. Specifically, it can be confirmed by measuring the amount of UFP at the outside of the exhaust fan 49 both when the filter 65 is provided in the duct 53 and when the filter 65 is not provided. The reason why UFP is caught in the filter 65, which is arranged parallel to the flow of the exhaust air in the enclosure 87, is that the exhaust air in the enclosure 87 turns into turbulence in the vicinity of the filter 65 and eventually forms eddies, and UFP is caught at the surface of the filter 65.

The base material of the filter 65 is plant fiber, mineral fiber, synthetic fiber, fabric, bounded-fiber fabric, felt, knit fabric, foamed resin, porous film, or the like. The surface of the filter 65. which is made of any base material has a number of small spaces such as gaps between fibers or holes.

The exhaust air in the enclosure 87 uniformly flows (i.e., the velocity gradient (velocity change) does not appear) at a distance away from the filter 65 in the air-conveying space 61 of the duct 53. Meanwhile, friction is caused on the surface of the filter 65. Therefore, the flow velocity continuously changes from the surface of the filter 65 to where the exhaust air uniformly flows. Therefore, the surface of the filter 65 is covered by a thin layer (boundary layer) where the velocity gradient is strong. The energy for carrying UFP is small due to the boundary layer and the eddy, formed because of the turbulence described above, and UFP is caught at the small spaces at the surface of the filter 65. The boundary layer changes according to UFP, which is captured and accumulated. The correlation between the size of UFP and that of the small spaces and the flow velocity of the exhaust air in the enclosure 87 are supposed to have an optimum value.

As described, in the present embodiment, there is no waste of space in the multifunction printer 11 because the duct 53 is located in the vicinity of the fuser assembly 23 and is parallel to the axis line 59 of the heating roller 59. As a result, the configuration of the multifunction printer 11 is simple and compact.

Specifically, in the present embodiment, it is possible to produce the multifunction printer 11 easily because the duct 53 is also a part of the wall section 55 of the fuser assembly enclosure 51. Also, there is no waste of space in the multifunction printer 11 because the duct 53 is located parallel to the axis line 59 of the heating roller 41 and adjacent to the fuser assembly enclosure 51, and only partition wall is provided between the duct 53 and the fuser assembly enclosure 51. As a result, the configuration of the multifunction printer 11 is simple and compact. Also, maintenance is easy because it is easy to replace the filter 65.

The filter 65 contacts the exhaust air in the enclosure 87 for a long time because the longitudinal direction of the filter 65 is parallel to the longitudinal direction of the duct 53. The filter 65 has increased efficiency in catching UFP and is able to reduce the emission of UFP to outside of the multifunction printer 11. Furthermore, the filter 65 does not cross over into the air-conveying space 61 of the duct 53 and is arranged in parallel to the flow direction of the exhaust air in the enclosure 87 in the air-conveying space 61. Therefore, the filter 65 can suppress the increase in resistance of air when the exhaust air in the enclosure 87 flows and suppress the increase in the output of the exhaust fan 49, which is different from the conventional transmission filter.

In the multifunction printer 11, the exhaust air in the enclosure 87 is allowed to contact the filter 65 efficiently because the filter 65 is installed at the duct ceiling surface 71 The exhaust air in the enclosure 87 includes water vapor generated when the non-fixed image is fixed on the paper 37 and UFP that is buoyant due to updraft. Especially shortly after the exhaust fan 49 stops, the filter 65 can capture UFP efficiently because the exhaust air in the enclosure 87 moves slowly to the vicinity of the duct ceiling surface 71 and remains there.

In the multifunction printer 11, the duct ceiling surface 71 slants upward as it extends away from the exhaust outlet 63, and the second side wall 73 is at an acute angle relative to the duct ceiling surface 71. Therefore, the air-conveying space 61, which is between the second side wall 73 and the filter 65, is a corner space which gradually narrows to the upside. In this corner space, the farther away from the exhaust fan 49, the more slowly air flows when it is exhausted because of a frictional force of the second side wall 73 and the filter 65. The exhaust air in the enclosure 87, which includes UFP that ascends with water vapor, is expected to ascend to the corner space, allowing UFP to accumulate at the filter 65 at the back of the corner space. As a result, the surface of the filter 65 is efficiently used at the back of the corner space.

Also, the multifunction printer 11 includes the filter 65, which includes the concave-convex surface 81 where groove portions 77 and projecting portions 79 are located respectively along a flow direction of the exhaust air in the enclosure 87. The flowing exhaust air in the enclosure 87 hits the groove portions 77 and the projecting portions 79 repeatedly and generate an eddy. Therefore, it is possible to increase the probability to catch UFP at the small spaces of the filter 65.

In the multifunction printer 11, a plurality of the exhaust outlets 63 are provided and each gap between exhaust outlets 63 and the area of each exhaust outlet 63 are appropriately set. Therefore, the variability of inlet flow of the exhaust air in the enclosure 87, which flow into the air-conveying space 61 and which varies according to the longitudinal direction of the duct 53, is less than when only one exhaust outlet 63 is installed.

In the multifunction printer 11, the amount of UFP contained in the exhaust air in the enclosure 87, which includes exhaust air from the fuser assembly 23, decreases and then the exhaust air in the enclosure 87 is exhausted from the exhaust aperture plane 83 of the exhaust fan 49 because the exhaust air in the enclosure 87 passes through the air-conveying space 61 of the duct 53. UFP which is still contained in the exhaust air in the enclosure 87 is caught at the transmission filter 85 because the exhaust air in the enclosure 87, which includes exhaust air from the fuser assembly 23, passes through the transmission filter 85. The transmission filter 85 supplementarily catches UFP because the transmission filter 85 covers the entire cross section of the duct 53. The ability of the filter 65 in the duct 53 and the transmission filter 85 can be adjusted appropriately. For example, the filter 65 of the duct 53 has a longer replacement cycle and the transmission filter 85 has a shorter replacement cycle.

The conventional configuration, which does not include the filter 65 in the duct 53, has to rely on only the transmission filter 85 to reduce UFP. In this case, if the transmissions filter 85 gets thicker to improve the efficiency in catching UFP, the output of the exhaust fan 49 needs to be bigger, and this makes a louder noise.

On the other hand, in the multifunction printer 11 that includes the filter 65 in the duct 53 of the present invention, the transmission filter 85 needs to have only the ability to work supplementarily. Therefore, in the multifunction printer 11 of the present invention, an air resistance does not increase and it can suppress the increase in the output of the exhaust fan 49.

Various embodiments are described above, but the present invention is not limited to these examples. It is obvious that one skilled in the art can implement a variety of changes and adjustments within the scope of claims, which are also within the technical scope of the invention.

Embodiments of the invention provide an image forming apparatus which has a simple structure, which reduces the discharge amount of UFP, and which suppresses the increase in the output of the exhaust fan 49.

The present application is based on Japanese Patent Application No. 2013-152769 filed on Jul. 23, 2013, the contents of which are incorporated herein by reference.

What is claimed is:

1. An image-forming apparatus defining a vertical direction extending from a top to a bottom of the image-forming apparatus in its intended orientation, the image-forming apparatus comprising:

a fuser assembly including a heating roller and a pressure roller for heating and pressurizing paper, on which a non-fixed image is applied and fixed, the fuser assembly extending in a longitudinal direction that is orthogonal to the vertical direction, the image-forming apparatus further defining a horizontal direction that is orthogonal to both the vertical direction and the longitudinal direction;

a duct located in the vicinity of the fuser assembly to extend in the longitudinal direction in parallel to the fuser assembly, and air in the duct is exhausted by an exhaust fan located at an end of the duct in the longitudinal direction;

an exhaust outlet located on a first side wall of the duct, the first side wall being orthogonal to the horizontal direction and located diagonally above the fuser assembly in the image-forming apparatus in its intended orientation, the exhaust outlet being provided to receive an exhaust air from the fuser assembly into the duct; and a plane filter attached to a duct ceiling surface of the duct, the duct ceiling surface extending along the longitudinal direction of the duct and being covered by the plane filter;

wherein a surface of the filter includes a concave-convex surface including a plurality of elongate groove portions and a plurality of elongate projecting portions, which extend in parallel with each other and orthogonally to the longitudinal direction of the duct, and the plurality of elongate groove portions and the plurality of elongate projecting portions are alternately arrayed along the longitudinal direction of the duct.

2. The image-forming apparatus according to claim 1, wherein the duct ceiling surface slants upward as it extends away from the exhaust outlet, and a second side wall which is on the opposite side of the duct ceiling surface from the first side wall is at an acute angle relative to the duct ceiling surface.

3. The image-forming apparatus according to claim 1, wherein the plane filter is parallel to the duct ceiling surface.

4. The image-forming apparatus according to claim 1, wherein the plane filter is parallel to the duct ceiling surface, and the duct ceiling surface slants upward as it extends away from the exhaust outlet, and a second side wall which is on the opposite side of the duct ceiling surface from the first side wall is at an acute angle relative to the duct ceiling surface.

5. The image-forming apparatus according to claim 1, further comprising a plurality of exhaust outlets provided along the longitudinal direction of the first side wall.

6. The image-forming apparatus according to claim 1, further comprising a transmission filter through which the exhaust air from the fuser assembly passes, the transmission filter being attached to an exhaust aperture plane of the exhaust fan.

7. An image-forming apparatus defining a vertical direction extending from a top to a bottom of the image-forming apparatus in its intended orientation, the image-forming apparatus comprising:

a fuser assembly including a heating roller and a pressure roller for heating and pressurizing paper, on which a non-fixed image is applied and fixed, the fuser assembly extending in a longitudinal direction that is orthogonal to the vertical direction, the image-forming apparatus further defining a horizontal direction that is orthogonal to both the vertical direction and the longitudinal direction;

a fuser assembly enclosure surrounding the fuser assembly;

a duct located in the vicinity of the fuser assembly to extend in the longitudinal direction in parallel to the fuser assembly, and air in the duct is exhausted by an exhaust fan located at an end of the duct in the longitudinal direction, the duct including a first side wall, the first side wall being orthogonal to the horizontal direction and located diagonally above the fuser assembly in the image-forming apparatus in its intended orientation, the first side wall forming part of a wall section of the fuser assembly enclosure;

an exhaust outlet located on the first side wall, the exhaust outlet being provided to receive an exhaust air from the fuser assembly enclosure into the duct; and, a plane filter attached to a duct ceiling surface of the duct, the duct ceiling surface extending along the longitudinal direction of the duct and being covered by the plane filter;

wherein a surface of the filter includes a concave-convex surface including a plurality of elongate groove portions and a plurality of elongate projecting portions, which extend in parallel with each other and orthogonally to the longitudinal direction of the duct, and the plurality of elongate groove portions and the plurality of elongate projecting portions are alternately arrayed along the longitudinal direction of the duct.

8. The image-forming apparatus according to claim 7, wherein the duct ceiling surface slants upward as it extends away from the exhaust outlet, and a second side wall which is on the opposite side of the duct ceiling surface from the first side wall is at an acute angle relative to the duct ceiling surface.

9. The image-forming apparatus according to claim 7, wherein the plane filter is parallel to the duct ceiling surface.

10. The image-forming apparatus according to claim 7, wherein the plane filter is parallel to the duct ceiling surface, and the duct ceiling surface slants upward as it extends away from the exhaust outlet, and a second side wall which is on the opposite side of the duct ceiling surface from the first side wall is at an acute angle relative to the duct ceiling surface.

11. The image-forming apparatus according to claim 7, further comprising a plurality of exhaust outlets provided along the longitudinal direction of the first side wall.

12. The image-forming apparatus according to claim 7, further comprising a transmission filter through which the exhaust air from the fuser assembly passes, the transmission filter being attached to an exhaust aperture plane of the exhaust fan.

* * * * *